United States Patent [19]

Jay, Jr. et al.

[11] Patent Number: 4,858,632

[45] Date of Patent: Aug. 22, 1989

[54] PNEUMATIC DESEDIMENTATION MACHINE

[76] Inventors: Jerry L. Jay, Jr., Rte. #3, Box 239; Ben Cottrell, Rte. 3, Box 313, both of Newbern, Tenn. 38059

[21] Appl. No.: 173,060

[22] Filed: Mar. 25, 1988

[51] Int. Cl.[4] ..... B08B 9/02

[52] U.S. Cl. ..... 134/57 R; 134/102; 134/108; 134/169 R; 134/169 C

[58] Field of Search ..... 134/102, 57 R, 169 R, 134/169 A, 169 C, 108

[56] References Cited

U.S. PATENT DOCUMENTS 3,771,539 11/1973 De Santis ..... 134/102 X
4,025,363 5/1977 De Santis ..... 134/102

*Primary Examiner*—Philip R. Coe

[57] ABSTRACT

The pneumatic desedimentation machine, is designed to provide a means of recirculating, reciprocally, a fixed volume of solvent or solution through a closed system such as boilers or equipment, water cooling and/or heating systems on machinery, or any other remote system, for the purpose of removing the calcium and/or mineral deposits which form on the inside of these systems and inhibit efficiency, in an efficient and safe manner, it could also be used, to clean the inside of distribution plumbing where sedimentation is a problem, such as is found in bulk paint systems. This is accomplished by the controlled flow of solvents and/or solutions from one reservoir to another through a remote system, which is the system being cleaned, by applied air and/or vapor pressure in a controlled reciprocating manner and at a controlled temperature for maximum efficiency of the solvent and/or solution used.

3 Claims, 2 Drawing Sheets

PNEUMATIC DESEDIMENTATION MACHINE

BACKGROUND OF INVENTION

Industry has long had a problem with calcium and mineral deposits which form on the inside of water heating and/or cooling systems, and inhibit there efficiency, and if left unchecked can render some machinery and/or equipment completely unusable, so it is necessary to periodically remove this sedimentation from the inside of machinery, equipment and plumbing systems, which has traditionally been accomplished by providing a reservoir of acid or solvent solution with a positive displacement recirculating pump system, which can create a hazard to workers and/or equipment because of the high pressures and velocities that can occur with fixed volume pumps, hoses, and/or other plumbing can rupture under high pressures potentially spraying workers and/or equipment with strong acids or solvents injuring the workers and damaging equipment, especially when used with acid solutions or strong solvents.

Further still, if sedimentation is severe it can restrict the flow to such a point that the velocities created by a positive displacement pump system can score or cut through water jackets in machinery and/or equipment creating a hazard and rendering the machinery and/or equipment useless.

It is therefore among the objects of this invention to provide a new and improved way to remove calcium and/or mineral deposits in remote systems which is safe to workers and machinery.

It is also an object of this invention to provide a new and improved way to remove calcium and/or mineral deposits which will utilize the maximum neutralizing effects of the solvents and/or solutions used efficiently.

It is also an object of this invention to provide a new and improved way of removing calcium and/or mineral deposits that is energy efficient.

Still further it is among the objects of this invention to provide a new and improved way of removing calcium and/or mineral deposits that the operation of is easy and time saving.

SUMMARY OF INVENTION

The Pneumatic Desedimentation machine, by utilizing a modification of air and/or vapor pressure as a motive force, as used in the DeSantis patents cited, will provide for a safe reliable and efficient means of removing calcium and/or mineral deposits from equipment and/or machinery without the use of positive displacement pumps, its design allows for the controlled low pressure flow of solvents and/or solution through cooling or heating systems that will automatically reciprocate, regenerate, and recirculate for an indefinite period of time, depending on the severity of the deposit, and maintain the solution and/or solvent at a controlled temperature to provide for its maximum efficiency.

With these and other objects in view, the invention consists in construction, arrangement, and combination of the various parts of the device, whereby the objects contemplated are attained as here in after set forth, and pointed out in the following description and illustrated in the accompanying drawings.

DESCRIPTION OF PREFERRED EMBODIMENTS

Figure 1:
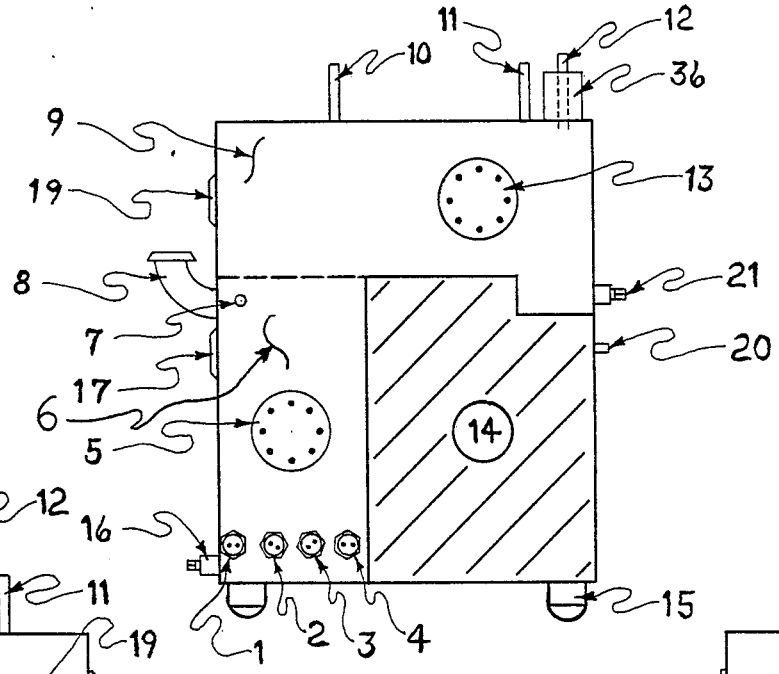
FIG. 1 is a front perspective view of the apparatus shown without electrical controls.
Figure 2:
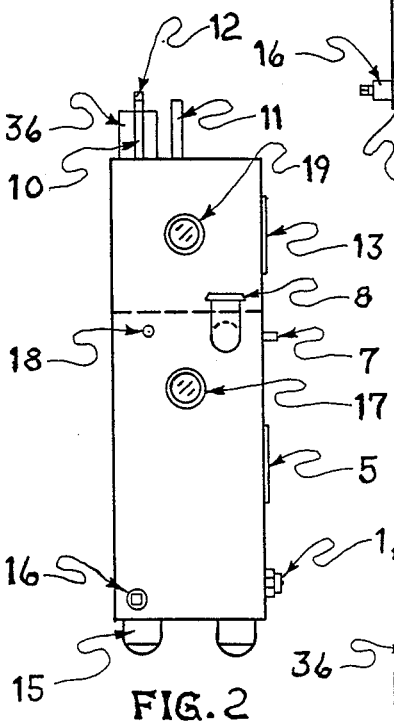
FIG. 2 shows left end exterior of the apparatus.
Figure 3:
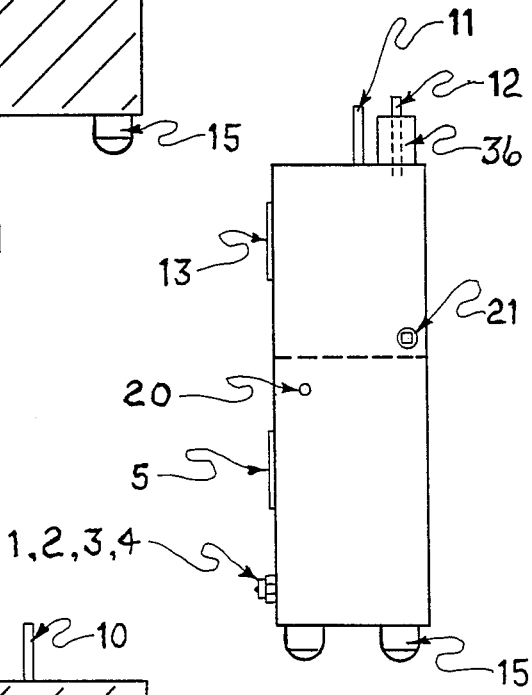
FIG. 3 shows right end extension of the apparatus.
Figure 4:
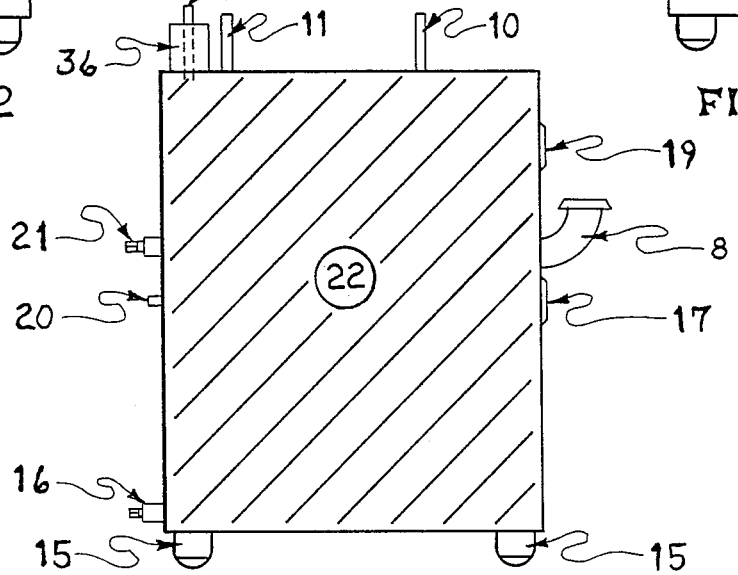
FIG. 4 shows a rear view of the apparatus which is void of any hardware of fittings and only constitutes a bulk head.(22)
Figure 5:
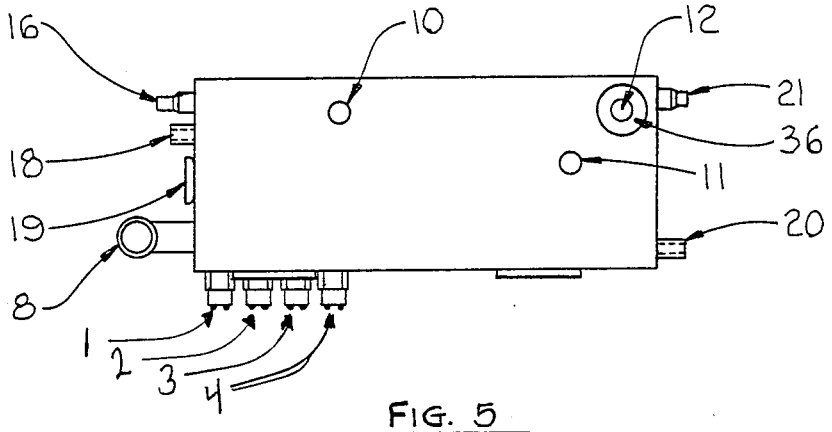
FIG. 5 shows a top exterior view of the apparatus.
Figure 6:
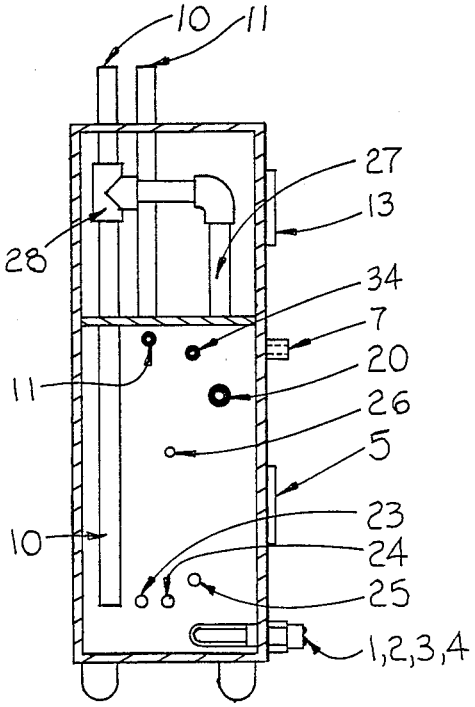
FIG. 6 shows a cutaway view of the left end of the apparatus shown in FIG. 2 demonstrating internal characteristic of the apparatus.
Figure 7:
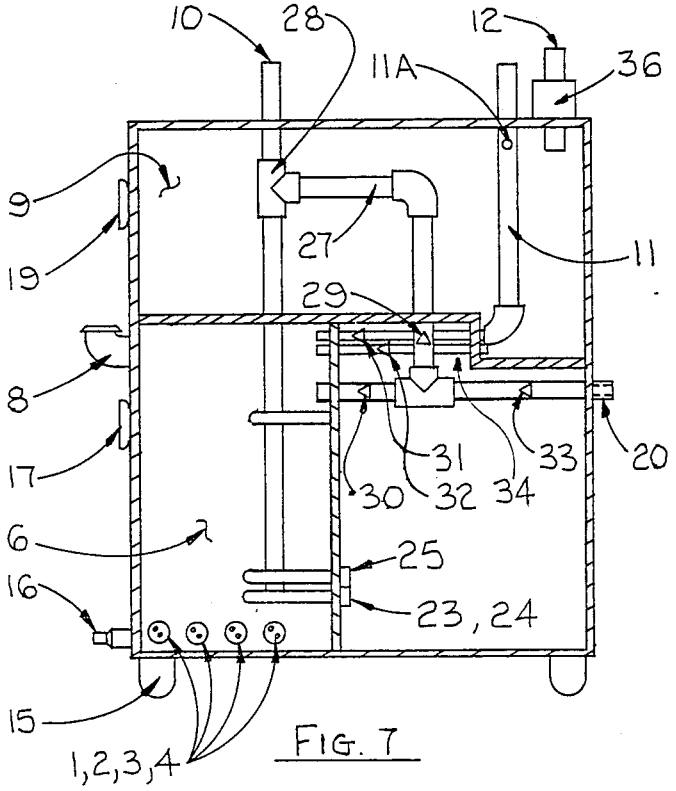
FIG. 7 shows a cutaway view of the front of the apparatus shown in FIG. 1 demonstrating the enter connecting plumbing and associated hardware.

The apparatus consists primarily of two tanks (6) and (9), (6) being the process or pressure tank (9) being the return tank.

The solution or solvent is introduced into the pressure tank (6) by means of a sealable filler cap (8) in a measured amount, to provide for convenient measuring of solution formulas, it is provided with a site gauge (17) for operator convenience.

After the solution is introduced to the process tank it is heated to, and maintained at, its maximum efficient temperature, which may very, depending on the nature of the sedimentation and the type of solvent and/or solution used. This is accomplished by activating, in a controlled manner, the heating elements, (1), (2), (3) and (4) located near the bottom of the process tank.

After the solution and/or solvent is heated to the prescribed temperature. The solenoid for applied air pressure (33) is automatically activated allowing air to pass through the air supply line (20) to the pressure tank (6) and will maintain a constant regulated pressure inside the pressure tank controlled by the in line regulator (30) and can be monitored by a pressure gauge in pressure gauge port (7).

When air pressure is applied, to the process tank, the solution is propelled thru the to process line (10) to remote work, to wit: water cooling and/or heating system on machinery or equipment, if air turbulence is required, or preferred, through the remote work in progress this can be accomplished by intermittently activating the solenoid for air turbulence (29) which will allow for air to be passed from the air supply line (20) through the air turbulence injection line (27) to the pipe fitting for air turbulence injection (28) and thereby intermittingly injecting air turbulence directly into the to process line, the solution and/or solvent used then passes through, and out of, the to process line through the work in progress, to wit; machinery, equipment, boiler; etc. by means of user supplied plumbing. In a manner that is controlled by the setting of the process pressure regulator (30) so that the solution and/or solvent is passed through the work in progress at low volumes and low velocities to provide for the maximum exposer time of solvent an/or solution to the sedimentation to provide for maximum neutralizing and desedimentation effects of the solution and/or solvent used.

It also allows for the controlled pressure and velocity, of the solution and/or solvent that is being forced through the work in progress to automatically be increased and/or decreased, depending on the rate of desedimentation, through the action of the air pressure regulator (30), thereby eliminating the hazardous potential of pressure or velocity surges found in positive displacement pump systems.

The solution and/or solvent being used will pass through the to process line (10) to the work in progress until the level of the solution and/or solvent exceeds the lower extension of the to progress line (10) which is placed above the level of the heater elements (1), (2), (3) and (4). And the heater element temperature control probes (23) and (24) so as to insure that the heating elements and the temperature probes remain positively submerged in the solution and/or solvent so as to prevent a false heating condition.

The solution will continue to pass through the to process line (10) and out of the unit to remote work in progress until the level is less than the level of the lower level control probe (25).

As the solution and or solvent is being passed through the to process line (10) and through the work in progress it is returned from the work in progress, by means of user supplied plumbing, to the return line (12) and passed into the return tank (9) and can be monitored by use of the provided site gauge (19).

The return line (12) is also provided with a condenser canister (36) that can be filled with water or dry ice, or similar substance to condense vapors back to liquid when high process temperatures are used.

The return tank (9) is designed to be a negative pressure receptacle for the process solution so that positive flow is insured from the process tank (6) through and out of the to process line (10) through the remote work in progress to the return line (12) and into the return tank (9) to provide this negative pressure receptacle the return tank is provided with an air vent orifice (11A) that is open to the atmosphere through the air vent line (11).

When the prescribed volume of solution and/or solvent has passed from the process tank (6) through the work in progress to the return tank, the lower level control (25) will signal the control circuitry that regeneration is necessary at which time the solenoid for applied air pressure (33) will be deactivated. And the solenoid for returning the solution from the return tank to the process tank (32) and the solenoid for venting entrapped air from the process tank to the atmosphere (31) will be activated, or opened, which will allow for the solution to pass from the return tank (9) through the solution transfer line (34) while the entrapped air in the process tank is simultaneously vented to the atmosphere through air vent line (11). This process will continue will the level in the process tank exceeds the level of the upper level control probe (26). At which time the solution return solenoid (32) and the air vent solenoid (31) are automatically deactivated, or closed, and the solenoid for applied air pressure (33) is activated, or opened, providing for continuous reciprocating action for whatever time period user desires.

The device is also provided with support devices (15) which can be fixed legs, casters, or can be eliminated depending on user needs.

The device is also provided with a clean out and inspection plate for the process tank (5) and the return tank (13). And a drain plug for the process tank (16) and the return tank (21).

This device is also provided with a positive air pressure bleed off valve port (18) to insure operator safety. Item #14, FIG. #1 is, area left blank to provide space for electrical controls.

Have described and illustrated the invention in what is conceived to be a practical and effective way, what is claimed as new in support of a patent is.

1. A device for the removal of deposits from the inside of machinery or equipment comprised of two tanks, one being a process or pressure tank for holding process solution, the other being a return tank for temporarily holding used process solution, that are interconnected by two pipes, one of which is for returning the used process solution from the return tank to the process tank, the other being for venting entrapped air from the process tank to the atmosphere and the flow through both pipes being controlled by solenoid operated valves so that they can be closed to allow the process tank, which is further supplied with an air supply line, the flow through which is also controlled by a solenoid operated valve, and is supplied with air pressure from an external source, that is still further supplied with a pressure regulator, to be pressurized, in a controlled manner, when the solenoid valve that controls the air flow through the air supply line is opened forcing the solution in the process tank through and out of a provided to process line and, by means of user supplied plumbing, through any remote machinery or equipment being cleaned and then into the return tank until the level of solution in the process tank goes below the level of the furthermost extension of the to process line within the process tank and the level of a lower level control probe within the process tank, at which time controls are signaled to open the solenoid valve for venting entrapped air from the process tank to the atmosphere and returning the solution from the return tank to the process tank and close the solenoid valve for controlling the supplied air pressure so that the solution can be transferred back to the process tank until the level of the solution in the process tank exceeds the level of an upper level control probe within said process tank which signals controls to close the solenoids for venting entrapped air from the process tank to the atmosphere and for returning the solution from the return tank to the process tank and open the solenoid for supplied air pressure which will allow for the process tank to repressurize and recirculate the solution and by automatically controlling the open/closed condition of these valves, the solution can be recirculated through the machinery or equipment being cleaned an infinite number of times until the deposits are removed or the solution is neutralized to allow for the maximum efficiency of the solution being used.

2. A device as in claim 1 that will automatically increase or decrease the flow of the solution through the machinery or equipment being cleaned, as deposits are removed, by the action of the pressure regulator in the air supply line which will increase or decrease the air flow to maintain a constant pressure in the process tank.

3. A device as in claim 1 in which the process tank is still further supplied with heating elements and temperature probes so that the solution can be heated in a controlled manner so that the maximum efficient temperature of the solution being used can be maintained.

* * * * *